US008821170B1

(12) United States Patent
Thein et al.

(10) Patent No.: US 8,821,170 B1
(45) Date of Patent: Sep. 2, 2014

(54) ELECTRICAL CONTACT HAVING MULTIPLE CANTILEVERED BEAMS

(76) Inventors: Robert Hla Thein, Fremont, CA (US); Henry Hla Thein, Fremont, CA (US)

( * ) Notice: Subject to any disclaimer, the term of this patent is extended or adjusted under 35 U.S.C. 154(b) by 190 days.

(21) Appl. No.: 13/553,073

(22) Filed: Jul. 19, 2012

(51) Int. Cl.
*H01R 25/00* (2006.01)

(52) U.S. Cl.
USPC ..... 439/121

(58) Field of Classification Search
USPC ..... 439/121–122, 247, 884, 717, 743–744
See application file for complete search history.

(56) References Cited

U.S. PATENT DOCUMENTS

| | | | | | |
|---|---|---|---|---|---|
| 4,662,706 | A | | 5/1987 | Foley | |
| 5,431,576 | A | * | 7/1995 | Matthews | 439/247 |
| 5,575,690 | A | * | 11/1996 | Eaton | 439/717 |
| 5,575,691 | A | * | 11/1996 | Matthews | 439/744 |
| 5,676,571 | A | * | 10/1997 | Matthews | 439/843 |
| 6,299,492 | B1 | * | 10/2001 | Pierini et al. | 439/884 |

* cited by examiner

*Primary Examiner* — Jean F Duverne
(74) *Attorney, Agent, or Firm* — Ted Masters

(57) ABSTRACT

An electrical contact includes a first set of spaced apart cantilevered beams connected to a first rail, and a second set of cantilevered beams connected to a second rail. The first set of cantilevered beams project toward the second rail, and the second set of cantilevered beams project toward the first rail, wherein the first and second sets of cantilevered beams reside in alternating relationship. Each cantilevered beam is bowed and is outwardly tapered from its connected proximal to its unconnected distal end.

9 Claims, 10 Drawing Sheets

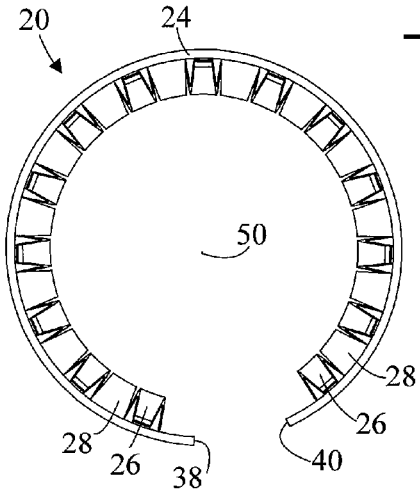
Fig. 18
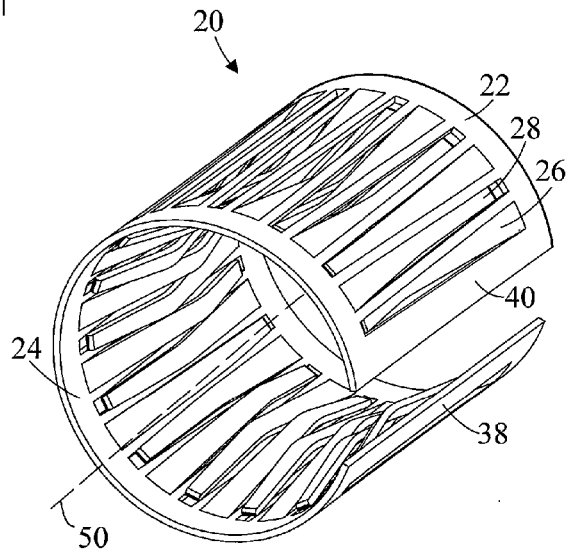
Fig. 20
Fig. 19
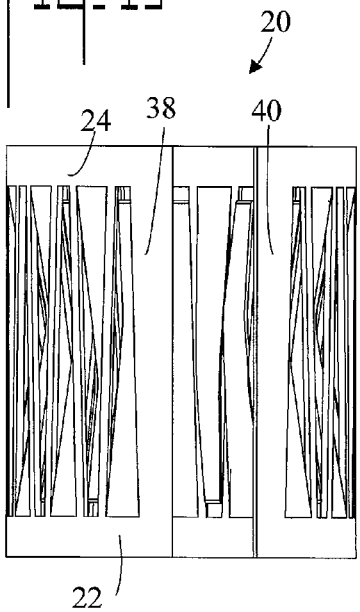

Fig. 23
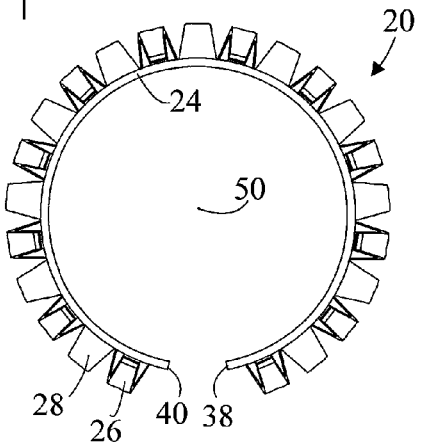
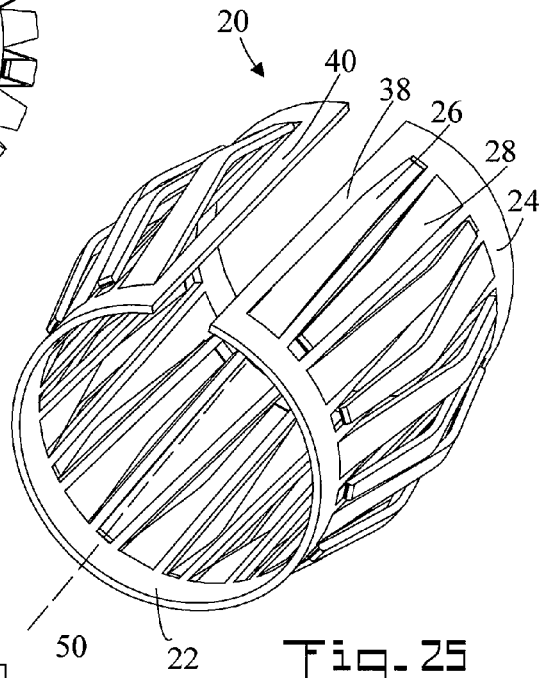
Fig. 24
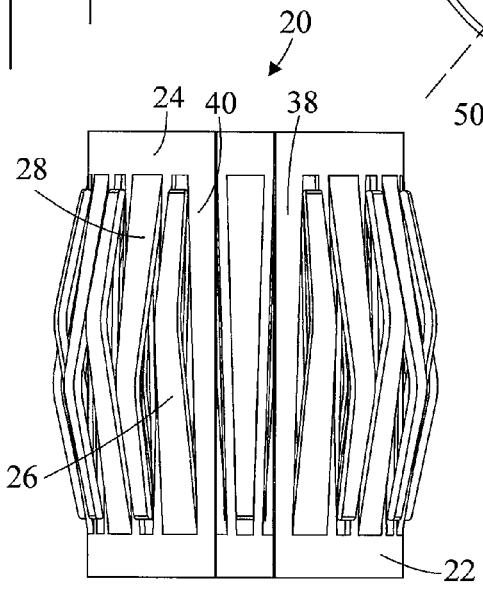
Fig. 25

ELECTRICAL CONTACT HAVING MULTIPLE CANTILEVERED BEAMS

CROSS REFERENCE TO RELATED APPLICATION

None

TECHNICAL FIELD

The present invention pertains generally to electrical connector, and more particularly to an electrical contact which has multiple cantilevered beams.

BACKGROUND OF THE INVENTION

Most electrical power distribution panels require connectors capable of handling high electrical current in small space. Electrical connectors which are capable of handling high amperage, and which mate to a male pin or blade, require a plurality of contact members or a large flat surface, both of which require a large area and preclude miniaturization. Most conventional miniature socket and male pin type electrical connectors have limited current carrying capability and are not suitable for high amperage.

Multiple contact members can be manufactured from a strip of sheet metal with gaps between each member, and then formed into a desired shape. These gaps will allow the members to flex freely during mating and extracting of the connector. However the necessity for the relatively large gaps reduces the contact surface and therefore lowers current carrying capacity. Some connectors use spring wires to act as beams. U.S. Pat. No. 4,662,706 discloses a multi-contact member band. Conversely, some connectors utilize large flat surfaces to carry current, but have limitations because of the surface irregularities on the mating surfaces.

BRIEF SUMMARY OF THE INVENTION

The present invention is directed to an electrical contact which is capable of handling high electrical current in a small space with low insertion and extraction forces, higher mating cycle, lower contact resistance, increased current carrying capacity, and minimum temperature rise. The electrical contact includes two sets of oppositely positioned and interleaved cantilevered beams which increase the electrical contact surface with a mating connector. The cantilevered beams have a low profile which can be stamped and formed from a single piece of conductive sheet metal, and which cannot be over deflected to the point of deformation. As such, the electrical contact maintains a consistent low mating insertion force while also providing a reliable electrical path. Manufacturing can be effected using a simple stamping process. Some of the features of the electrical contact are:

- Multiple cantilevered beams fitted into small space to handle higher electrical current
- Contact surfaces are larger and wider to handle higher electrical current
- Alternate beams are axially spaced (different plane) to increase contact surface and to reduce insertion force
- The cantilevered beams are tapered in order to minimize the gap between adjacent beams
- Independent cantilever beam design improves reliability
- Small mating angles to help reduce insertion force
- Simple stamping process on a single piece of metal with no cutting or welding
- Lower cost manufacturing In accordance with an embodiment of the invention, an electrical contact includes a first rail, and a second rail which is connected parallel to the first rail. A plurality of spaced apart first cantilevered beams are connected to the first rail, the first cantilevered beams project from the first rail toward the second rail. A plurality of spaced apart second cantilevered beams are connected to the second rail, the second cantilevered beams project from the second rail toward the first rail. The first cantilevered beams reside in interleaved relationship with the second cantilevered beams.

In accordance with another embodiment, the first cantilevered beams each have a proximal end connected to the first rail and an opposite distal end, and are tapered from the proximal end to the distal end. Similarly, the second cantilevered beams each have a proximal end connected to the second rail and an opposite distal end, and are tapered from the proximal end to the distal end.

In accordance with another embodiment, the first cantilevered beams and the second cantilevered beams each having a same taper angle.

In accordance with another embodiment, the taper angle determines a force required to insert a mating connector into the electrical contact, wherein a smaller taper angle results in a smaller insertion force.

In accordance with another embodiment, two end members connect the first rail to the second rail. When viewed from the end members the first cantilevered beams and the second cantilevered beams are each bowed.

In accordance with another embodiment, the first cantilevered beans and the second cantilevered beams each project a maximum height above the end members. The maximum height is located closer to the distal ends than to the proximal ends. So that, when the mating connector is inserted parallel to the first and second end members, the mating connector will engage one of the first cantilevered beams and the second cantilevered beams before engaging the other of the first cantilevered beams and the second cantilevered beams.

In accordance with another embodiment, the maximum height is located about two thirds of the way from the proximal end to the distal end.

In accordance with another embodiment, a plurality of support members are connect the first rail to the second rail. One support member is disposed between each first cantilevered beam and the adjacent second cantilevered beam.

In accordance with another embodiment, the support members having a width of about 0.008 inches.

In accordance with another embodiment, the first and second rails are formable into a cylindrical shape having a center wherein the first cantilevered beams and the second cantilevered beams either (1) inwardly project toward the center of the cylindrical shape, or (2) outwardly project away from the center of the cylindrical shape.

Other embodiments, in addition to the embodiments enumerated above, will become apparent from the following detailed description, taken in conjunction with the accompanying drawings, which illustrate, by way of example, the principles of the electrical contact.

BRIEF DESCRIPTION OF THE DRAWINGS

FIG. 18 is an end view of the electrical contact formed into a cylindrical shape with inwardly projecting first and second cantilevered beams;

FIG. 19 is a side elevation view of the electrical contact of FIG. 18;

FIG. 20 is a perspective view of the electrical contact of FIG. 18;

FIG. 23 is an end elevation view of the electrical contact formed into a cylindrical shape with outwardly projecting first and second cantilevered beams;

FIG. 24 is a side elevation view of the electrical contact of FIG. 23;

FIG. 25 is a perspective view of the electrical contact of FIG. 23; and, FIG. 26 is a reduced perspective view of the electrical contact of FIGS. 23-25 installed in a connector.

DETAILED DESCRIPTION OF THE INVENTION

Figure 1:
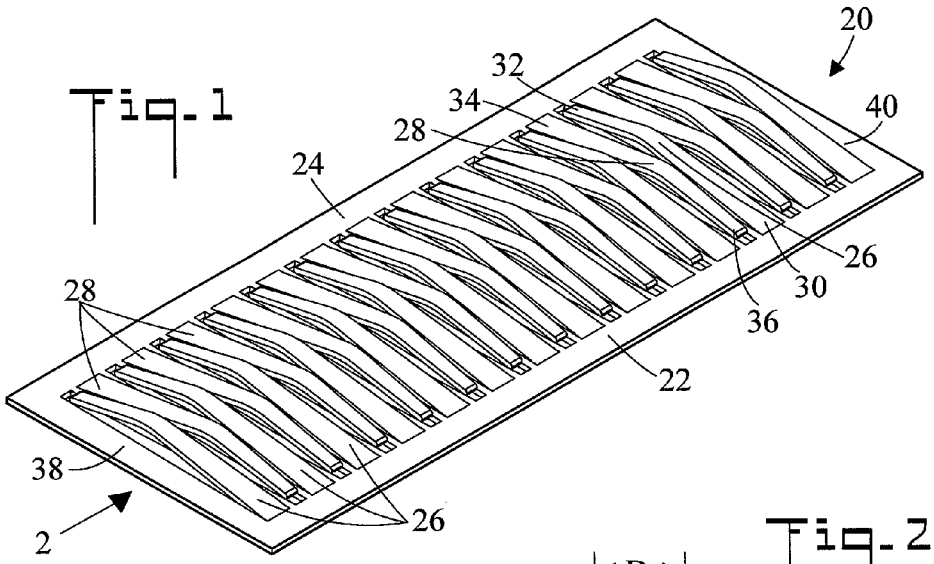
FIG. 1 is a perspective view of an electrical contact.

Referring initially to FIGS. 1-4, there are illustrated perspective, enlarged end, top plan, and side elevation views respectively of an electrical contact generally designated as 20. As used herein the term electrical contact means a contact which allows current to pass from one conductor to another conductor. Electrical contact 20 includes a first rail 22, and a spaced-apart second rail which is connected to and parallel with first rail 22. A plurality of spaced apart first cantilevered beams 26 are connected to first rail 22. First cantilevered beams 26 project from first rail 22 toward second rail 24. A plurality of spaced apart second cantilevered beams 28 are connected to second rail 24. Second cantilevered beams 28 project from second rail 24 toward first rail 22. First cantilevered beams 26 reside in interleaved (alternating) relationship with second cantilevered beams 28. It may be appreciated that first 22 and second rails 24 can either be elongated separate members as shown in FIGS. 1-4, or alternatively can be integrated into the structure of a connector assembly as shown in FIGS. 5-10.

First cantilevered beams 26 each have a proximal end 30 which is connected to first rail 22 and an opposite unconnected distal end 32. In the shown embodiment first cantilevered beams 26 are each outwardly tapered from connected proximal end 30 to free distal end 32. Tapered means that the beams decrease in width from proximal end 30 to distal end 32. Similarly, second cantilevered beams 28 each have a proximal end 34 which is connected to second rail 24 and an opposite unconnected distal end 36, and are each tapered from proximal end 34 to distal end 36. Put a different way, in the shown embodiment first cantilevered beams 22 include first tapered tines which project from first rail 22 toward second rail 24, and second cantilevered beams 24 include second tapered tines which project form from second rail 24 toward first rail 22. The first tapered tines reside in alternating relationship with the second tapered tines, and the tapered ends point in opposite directions. This mirror image configuration allows the space between the beams to be kept at a minimum.

In the shown embodiment, first cantilevered beams 26 and second cantilevered beams 28 each having a same taper angle A. Taper angle A is defined as the angle between the centerline of the beam 37 and the edge of the beam (refer to FIG. 3). Taper angle A determines the force required to insert a mating connector 500 into electrical contact 20, wherein a smaller taper angle A results in a smaller insertion force (also refer to FIGS. 11-13) and the associated discussions). In other words, the force required to insert mating connector 500 is proportional to taper angle A.

Two end members 38 and 40 connect first rail 22 to second rail 24. When viewed from end members 38 and 40 (as in FIG. 2) first cantilevered beams 26 and second cantilevered beams 28 are each bowed. Bowed means that first cantilevered beams 26 and second cantilevered beams 28 bend outwardly (upwardly as shown) away from the plane defined by rails 22 and 24, and end member 38 and 40.

Figure 2:
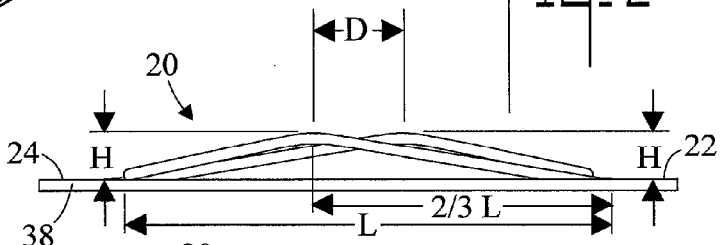
FIG. 2 is an enlarged end view of the electrical contact in direction 2 of FIG. 1.
Figure 3:
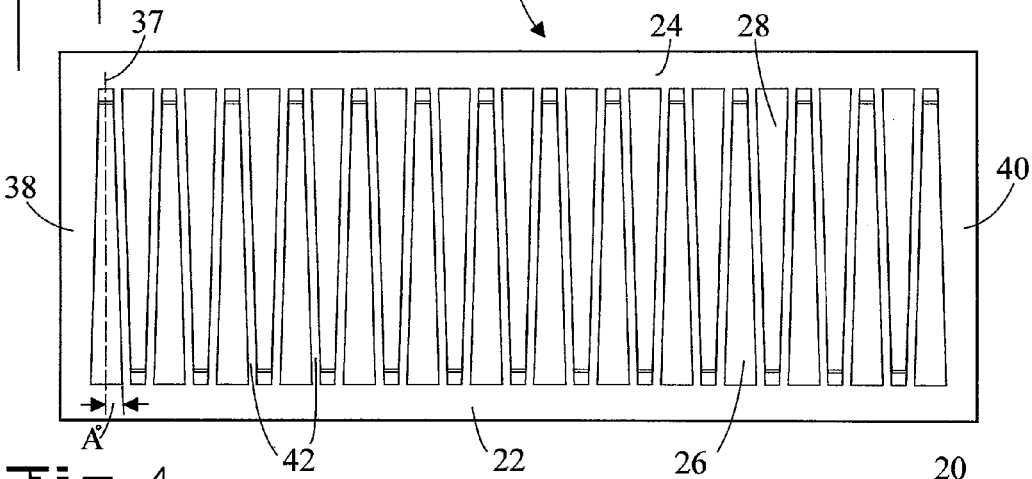
FIG. 3 is a top plan view of the electrical contact.
Figure 4:
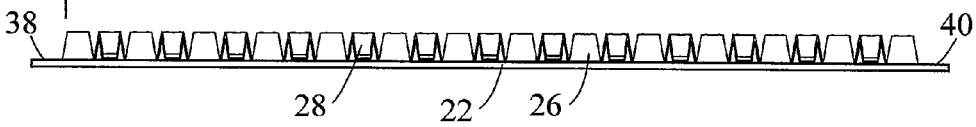
FIG. 4 is a side elevation view of the electrical.
Figure 5:
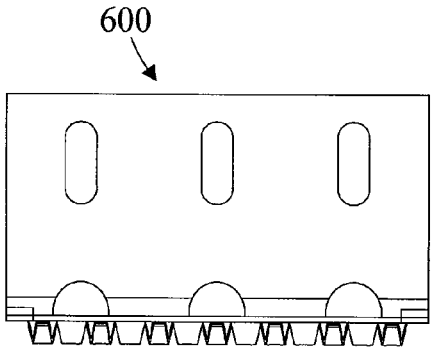
FIG. 5 is a top plan view of the electrical contact configured for a blade connector.
Figure 6:
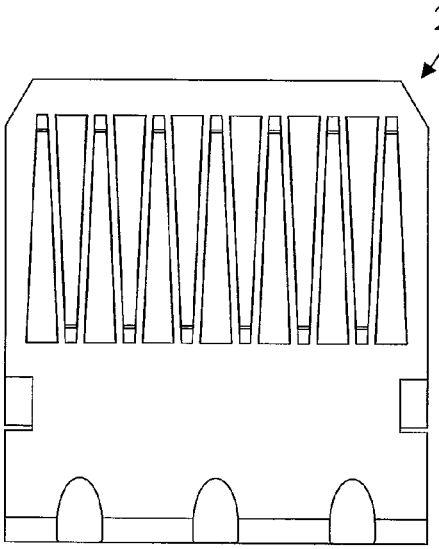
FIG. 6 is a front elevation view of the blade connector embodiment.
Figure 7:
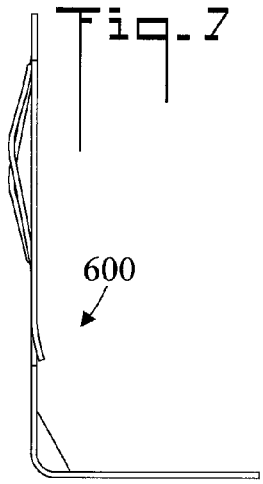
FIG. 7 is a side elevation view of the blade connector embodiment.
Figure 8:
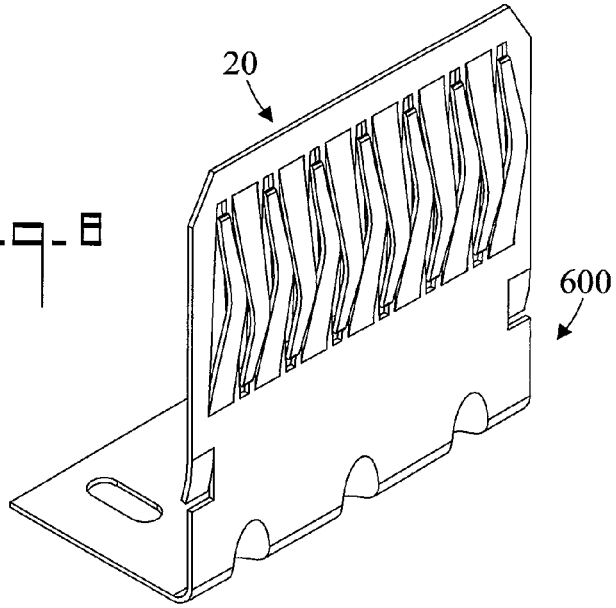
FIG. 8 is a perspective view of the blade connector embodiment.

Referring to FIG. 2, first cantilevered beans 26 and second cantilevered beams 28 each projecting a maximum height H above end members 38 and 40. Maximum height H for first cantilevered beams 26 and second cantilevered beams 28 is located closer to distal ends 32 and 36 respectively than to proximal ends 30 and 34 respectively. In the shown embodiment, maximum height H is located about two thirds of the way from proximal end 30 (or 34) to distal end 32 (or 36). If L is the length of the beams, then maximum H will be located about ⅔ L away from distal end 30 (or 34). Because of this arrangement the engaging surfaces of the first and second beams are longitudinally staggered by a distance D. This arrangement provide extra spaces to have a wider mating surface area and therefore greater current carrying capacity A plurality of support members 42 connect first rail 22 to second rail 24. One support member 42 is disposed between each first cantilevered beam 26 and adjacent second cantilevered beam 28. In an embodiment, support members 42 are thin and have a width of about 0.008 inches.

FIGS. 5-8 are top plan, front elevation, side elevation, and perspective views respectively electrical contact 20 configured for a blade connector. Electrical contact 20 is part of a half-connector base 600.

Figure 9:
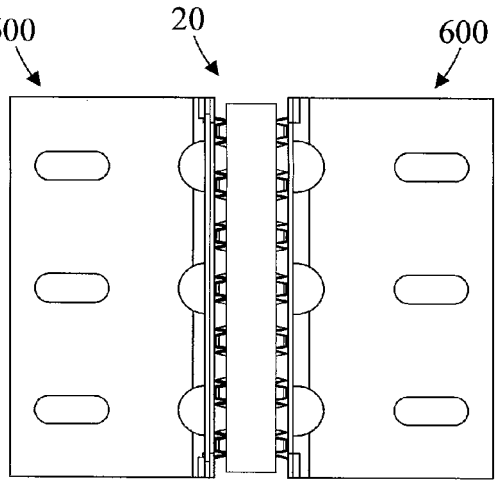
FIG. 9 is a top plan view of the blade connector embodiment.
Figure 10:
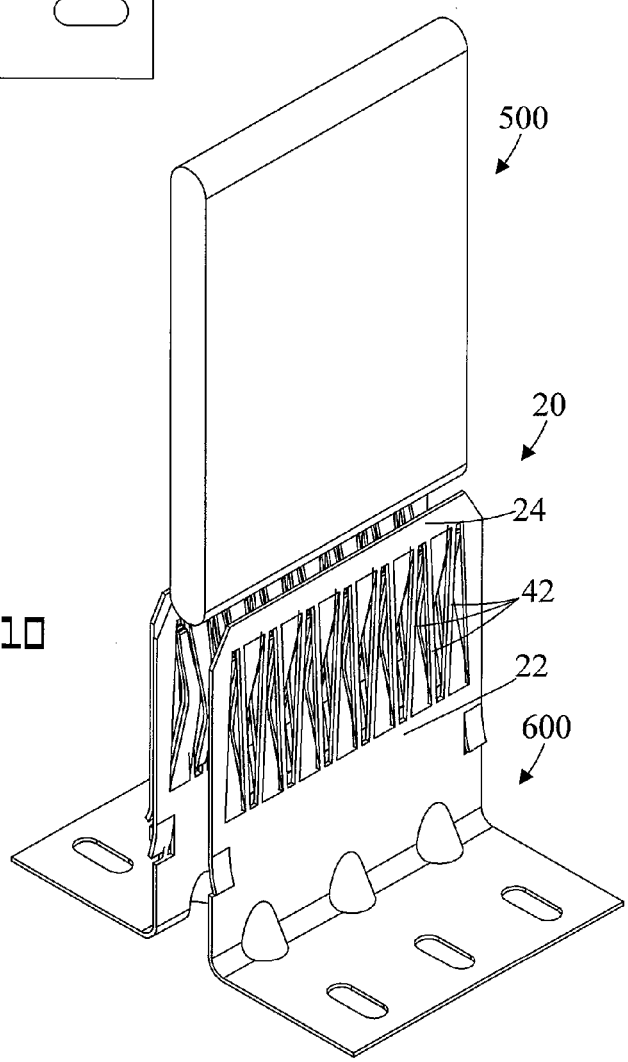
FIG. 10 is a perspective view of the blade connector embodiment receiving a blade connector.

FIGS. 9-10 are top plan and perspective views respectively of the blade connector embodiment. Two half-connector bases 600 are positioned in adjacent relationship, so that a mating blade connector 500 may be inserted therebetween to make electrical contact. As mating connector 500 is inserted between bases 600, each beam (26 and 28) will independently resiliently push against the flat surface of mating connector 500, and provide sufficient spring force to maintain a good electrical path. It is noted that in FIG. 10, first rail 22 is part of base 600.

Figure 11:
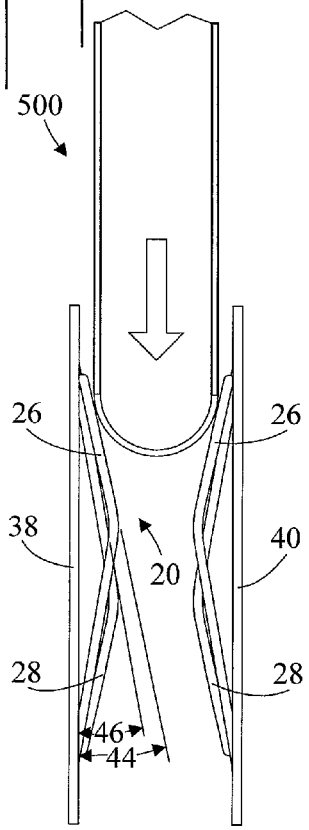
FIG. 11 is an enlarged side elevation view of the mating connector positioned to engage the electrical contact.
Figure 12:
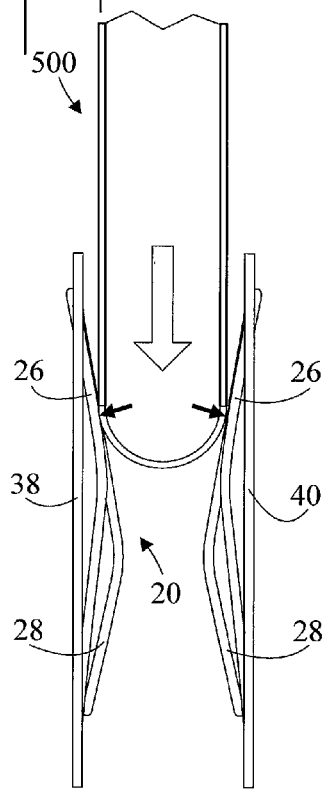
FIG. 12 is an enlarged side elevation view of the mating connector engaging first cantilever beams of the electrical contact.
Figure 13:
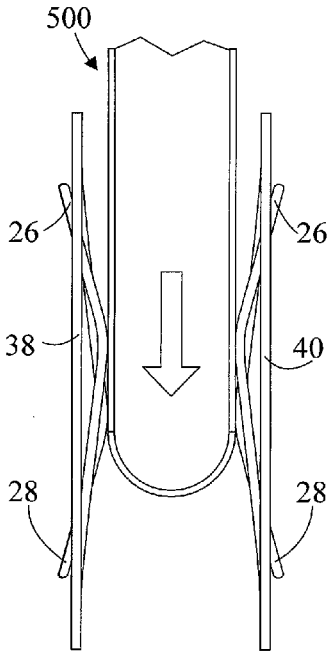
FIG. 13. is an enlarged side elevation view of the mating connector engaging first cantilever beams and second cantilever beams of the electrical contact.

FIG. 11 is an enlarged side elevation view of mating connector 500 positioned to engage electrical contact 20, FIG. 12 is an enlarged side elevation view of the mating connector engaging first cantilever beams 26 of electrical contact 20, and FIG. 13. is an enlarged side elevation view of mating connector 500 engaging first cantilever beams 26 and second cantilever beams 28 of electrical contact 20. When mating connector 500 is initially inserted into contact 20 parallel to first 38 and second 40 end members, mating connector 500 will engage one of first cantilevered beams 26 and second cantilevered beams 28 before engaging the other of first cantilevered beams 26 and second cantilevered beams 28. As shown, mating connector 500 first engages first cantilevered beams 26 (half of the beams), and then will engage second cantilevered beams 28 (the other half of the beams) as mating connector 500 is further inserted into electrical contact 20 (refer to FIG. 13). This successive stressing of the beams reduces the insertion force required to mate the connector. It is further noted that first 26 and second 28 cantilever beams are formed (bowed) to have small initial mating angles 44 and 46 respectively. This both (1) helps reduce the force during insertion, and (2) improves electrical performance by wiping the two mating surfaces to decrease contact resistance and minimize temperature rise.

Figure 14:
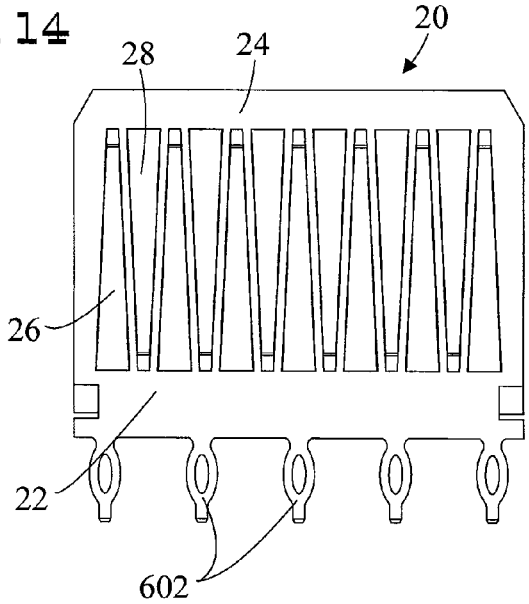
FIG. 14 is a front elevation view of a second blade connector embodiment.
Figure 15:
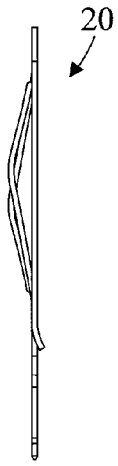
FIG. 15 is a side elevation view of the second blade connector embodiment.
Figure 16:
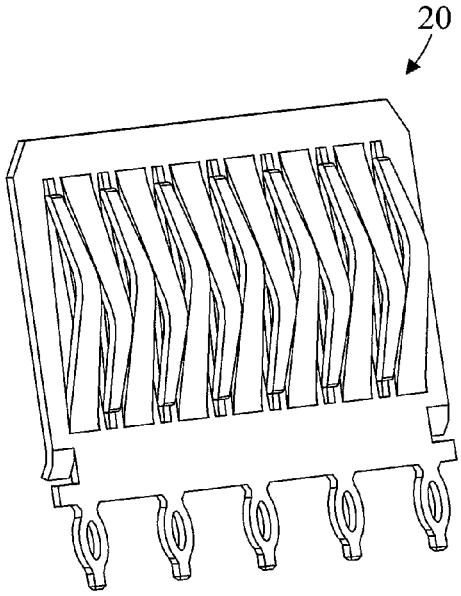
FIG. 16 is a perspective view of the second blade connector embodiment.
Figure 17:
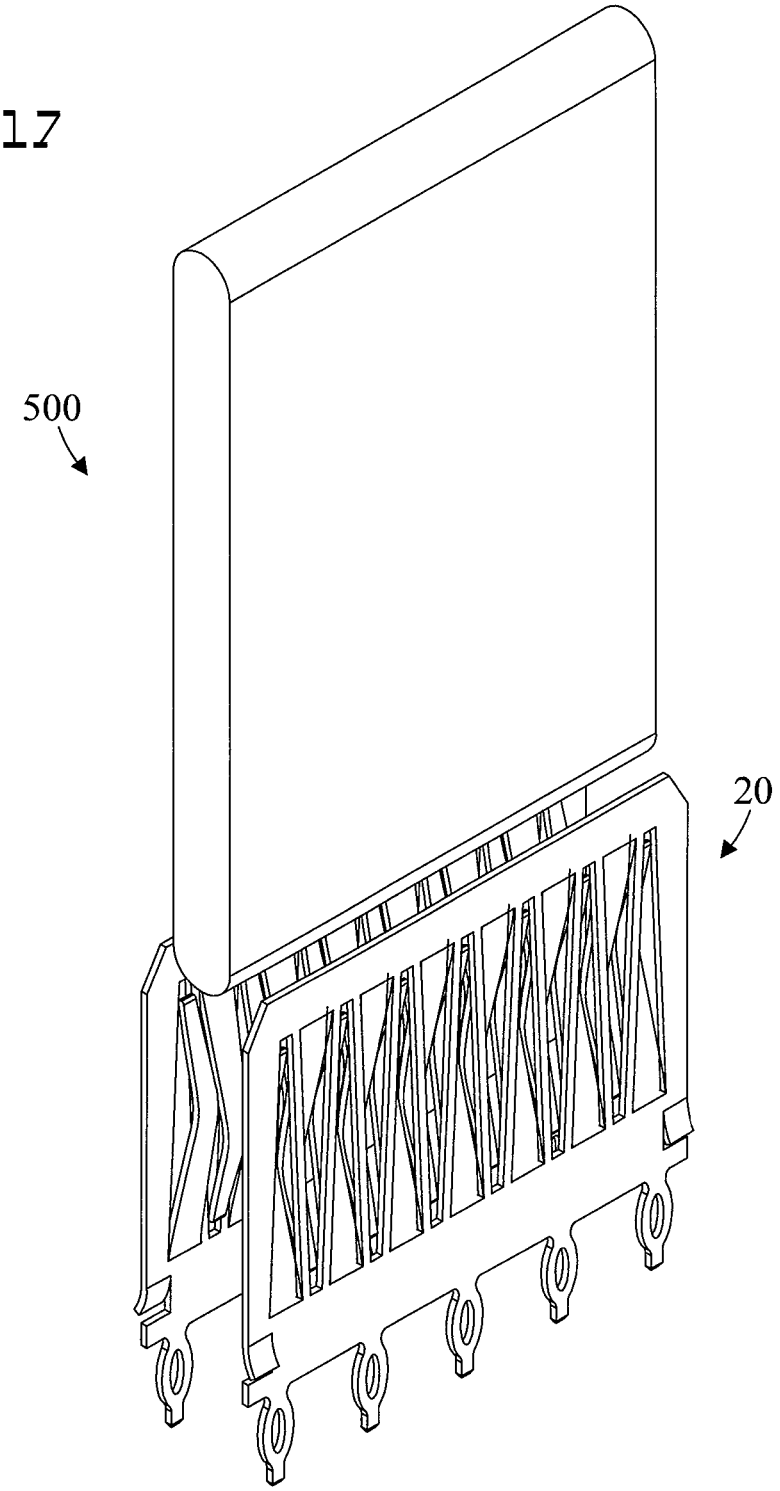
FIG. 17 is a perspective view of the second blade connector embodiment receiving a blade connector.

FIGS. 14-16 are front elevation, side elevation, and perspective views respectively of a second blade connector embodiment. Shown are first rail 22, second rail 24, first cantilevered beams 26, and second cantilevered beams 28. FIG. 17 is a perspective view of the second blade connector embodiment receiving a blade connector 500. Electrical contact 20 is part of a frame which has press fit compliant "tails" 602 which are utilized to attach the frame to a circuit board as is well known in the art.

FIG. 18 is an end view of electrical contact 20 formed into a cylindrical shape with inwardly projecting first 26 and second 28 cantilevered beams. Electrical contact 20 is rolled into a cylindrical shape. FIGS. 19-20 are side elevation and perspective views respectively of the rolled electrical contact 20 of FIG. 18. Shown are first rail 22, second rail 24, first cantilevered beams 26, second cantilevered beams 28, and end members 38 and 40. In this embodiment a cylindrical mating connector 500 engages electrical contact 20 (refer to FIGS. 21 and 22). That is, first 22 and second 24 rails are formable into a cylindrical shape having a center 50 (central axis), wherein first cantilevered beams 26 and second cantilevered beams 28 either (1) inwardly project toward center 50 of the cylindrical shape (as shown in FIGS. 18-20), or alternatively (2) outwardly project away from center 50 of the cylindrical shape (as shown in FIGS. 23-25).

Figure 21:
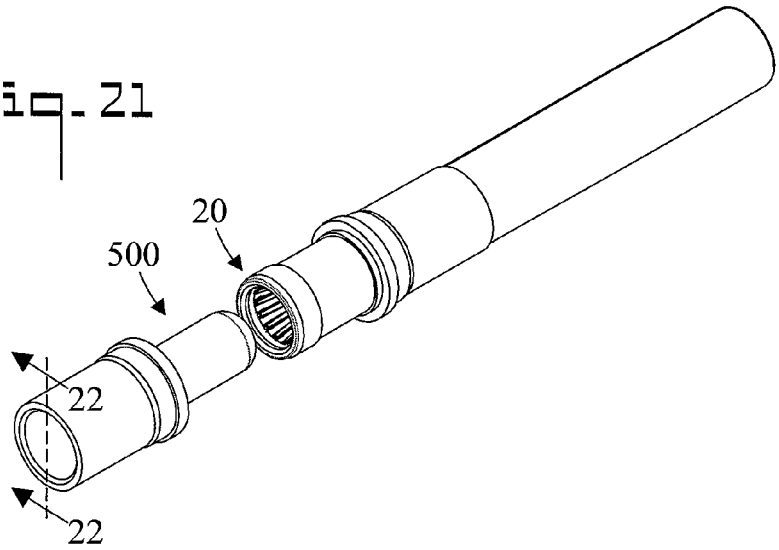
FIG. 21 is a reduced perspective view of the electrical contact of FIGS. 18-20 installed in a connector.
Figure 22:
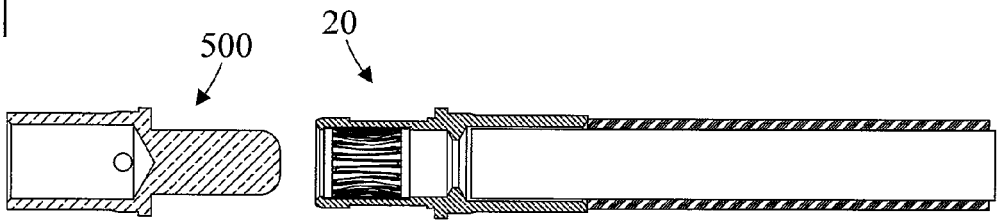
FIG. 22 is a cross sectional view along the line 22-22 of FIG. 21.

FIG. 21 is a reduced perspective view of the electrical contact of FIGS. 18-20 installed in a connector, and FIG. 22 is a cross sectional view along the line 22-22 of FIG. 21. Electrical contact 20 is formed into a cylindrical shape and installed within the connector. When cylindrical male mating connector 500 is inserted into electrical contact 20, each beam independently mates against the surface of mating connector 500 and provides sufficient spring force to maintain good electrical connection.

FIGS. 23-25 are end elevation, side elevation, and perspective views respectively of electrical contact 20 formed into a cylindrical shape with outwardly projecting first 26 and second 28 cantilevered beams. Electrical contact 20 is rolled into a cylindrical shape with first 26 and second 28 cantilevered beams extending outward.

Figure 26:
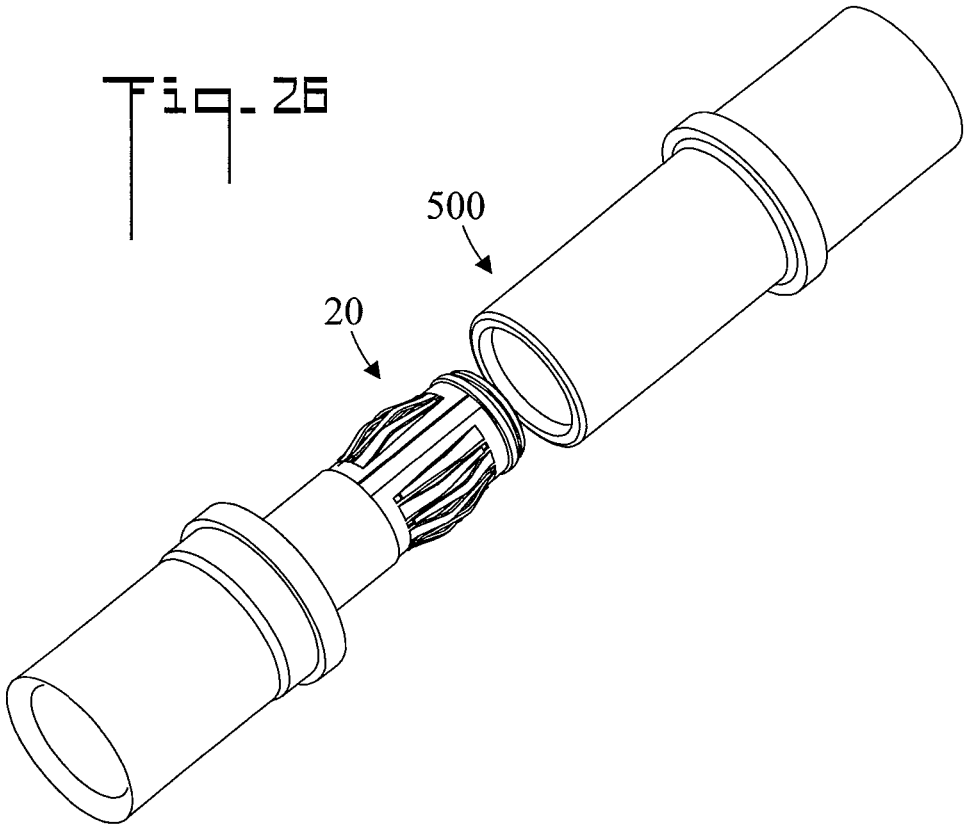

FIG. 26 is a reduced perspective view of electrical contact 20 of FIGS. 23-25 installed in a connector. Electrical contact 20 is formed into a cylindrical shape and installed on one half of a connector. Electrical contact 20 is then inserted into a female mating connector 500, wherein each beam independently mates against the surface of mating connector 500 and provides sufficient spring force to maintain good electrical connection.

The design of electrical contact 20 provides maximum amount of electrical contact within a minimum space. Electrical contact 20 fits into small spaces such as computers, electronic components, and dense power distribution panels, and provides increased current carrying capability and lower contact resistance thereby minimizing the temperature rise at the contact junction.

Electrical contact 20 can be manufactured utilizing a simple stamping process on a single sheet of metal with no cutting or welding required, and with dies utilized to form the bow shape of the beams. The cantilevered beams laid out with the wider ends starting at the base metal and tapered towards the tip as it cantilevers out. This gradual width reduction of the beams from the contact curvatures assure uniform stress loading of the cantilever beams during insertion.

The embodiments of the electrical contact described herein are exemplary and numerous modifications, combinations, variations, and rearrangements can be readily envisioned to achieve an equivalent result, all of which are intended to be embraced within the scope of the appended claims. Further, nothing in the above-provided discussions of the electrical contact should be construed as limiting the invention to a particular embodiment or combination of embodiments. The scope of the invention is defined by the appended claims.

We claim:

1. An electrical contact, the electrical contact cooperating with a mating connector, the electrical contact comprising:

a first rail;

a second rail connected to and parallel with said first rail;

a plurality of spaced apart first cantilevered beams connected to said first rail, said first cantilevered beams projecting from said first rail toward said second rail;

a plurality of spaced apart second cantilevered beams connected to said second rail, said second cantilevered beams projecting from said second rail toward said first rail;

said first cantilevered beams residing in interleaved relationship with said second cantilevered beams;

two end members connecting said first rail to said second rail;

when viewed from said end members said first cantilevered beams and said second cantilevered beams each being bowed;

said first cantilevered beans and said second cantilevered beams each projecting a maximum height above said end members;

said first cantilevered beams each having a proximal end connected to said first rail and an opposite distal end;

said second cantilevered beams each having a proximal end connected to said second rail and an opposite distal end;

said maximum height being located closer to said distal ends than to said proximal ends; and, so that when the mating connector is inserted parallel to said first and second end members, the mating connector will engage one of said first cantilevered beams and said second cantilevered beams before engaging the other of said first cantilevered beams and said second cantilevered beams.

2. The electrical contact according to claim 1, further including:

said maximum height being located about two thirds of the way from said proximal end to said distal end.

3. An electrical contact, comprising:

a first rail;

a second rail connected to and parallel with said first rail;

a plurality of spaced apart first cantilevered beams connected to said first rail, said first cantilevered beams projecting from said first rail toward said second rail;

a plurality of spaced apart second cantilevered beams connected to said second rail, said second cantilevered beams projecting from said second rail toward said first rail;

said first cantilevered beams residing in interleaved relationship with said second cantilevered beams;

a plurality of support members connecting said first rail to said second rail; and, one said support member disposed between each said first cantilevered beam and said adjacent second cantilevered beam.

4. The electrical contact according to claim 3, further including:

said support members having a width of about 0.008 inches.

5. An electrical contact, the electrical contact cooperating with a mating connector, the electrical contact comprising:

a first rail;

a second rail connected to and parallel with said first rail;

a plurality of spaced apart first cantilevered beams connected to said first rail, said first cantilevered beams projecting from said first rail toward said second rail;

a plurality of spaced apart second cantilevered beams connected to said second rail, said second cantilevered beams projecting from said second rail toward said first rail;

said first cantilevered beams residing in interleaved relationship with said second cantilevered beams;

said first cantilevered beams each having a proximal end connected to said first rail and an opposite distal end;

said first cantilevered beams each being tapered from said proximal end to said distal end;

said second cantilevered beams each having a proximal end connected to said second rail and an opposite distal end;

said second cantilevered beams each being tapered from said proximal end to said distal end;

said first cantilevered beams and said second cantilevered beams each having a same taper angle;

said taper angle determining a force required to insert the mating connector into said electrical contact, wherein a smaller said taper angle results in a smaller said insertion force;

two end members connecting said first rail to said second rail;

when viewed from said end members said first cantilevered beams and said second cantilevered beams each being bowed;

said first cantilevered beans and said second cantilevered beams each projecting a maximum height above said end members;

said first cantilevered beams each having a proximal end connected to said first rail and an opposite distal end;

said second cantilevered beams each having a proximal end connected to said second rail and an opposite distal end;

said maximum height being located closer to said distal ends than to said proximal ends;

so that when the mating connector is inserted parallel to said first and second end members, the mating connector will engage one of said first cantilevered beams and said second cantilevered beams before engaging the other of said first cantilevered beams and said second cantilevered beams;

a plurality of support members connecting said first rail to said second rail; and, one said support member disposed between each said first cantilevered beam and said adjacent second cantilevered beam.

6. An electrical contact, the electrical contact cooperating with a mating connector, the electrical comprising:

a first rail;

a second rail connected to and parallel with said first rail;

a plurality of spaced apart first tapered tines connected to said first rail, said first tapered tines projecting from said first rail toward said second rail;

a plurality of spaced apart second tapered tines connected to said second rail, said second tapered tines projecting from said second rail toward said first rail;

said first tapered tines residing in alternating relationship with said second tapered tines two end members connecting said first rail to said second rail;

when viewed from said end members said first tapered tines and said second tapered tines each being bowed;

said first tapered tines and said second tapered tines each projecting a maximum height above said end members;

said first tapered tines each having a proximal end connected to said first rail and an opposite distal end;

said second tapered tines each having a proximal end connected to said second rail and an opposite distal end;

said maximum height being located closer to said distal ends than to said proximal ends; and, so that when the mating connector is inserted parallel to said first and second end members, the mating connector it will engage one of said first tapered tines and said second tapered tines before engaging the other of said first tapered tines and said second tapered tines.

7. The electrical contact according to claim 6, further including:

said maximum height being located about two thirds of the way from said proximal end to said distal end.

8. An electrical contact, comprising:

a first rail;

a second rail connected to and parallel with said first rail;

a plurality of spaced apart first tapered tines connected to said first rail, said first tapered tines projecting from said first rail toward said second rail;

a plurality of spaced apart second tapered tines connected to said second rail, said second tapered tines projecting from said second rail toward said first rail;

said first tapered tines residing in alternating relationship with said second tapered tines.

a plurality of support members connecting said first rail to said second rail; and, one said support member disposed between each said first tapered tine and said adjacent second tapered tine.

9. The electrical contact according to claim 8, further including:

said support members having a width of about 0.008 inches.

* * * * *